US005154162A

United States Patent [19]

Chang

[11] Patent Number: 5,154,162

[45] Date of Patent: Oct. 13, 1992

[54] GAS-FIRED WATER HEATER WITH COMBUSTION-AID SUPPLY SYSTEM

[76] Inventor: Che-Yuan Chang, c/o Hung Hsing Patent Service Center P.O. Box 55-1670, Taipei (10477), Taiwan

[21] Appl. No.: 772,449

[22] Filed: Oct. 7, 1991

[51] Int. Cl.[5] ..... F24H 1/00

[52] U.S. Cl. ..... 126/351; 122/14; 122/448.1; 137/595; 431/10

[58] Field of Search ..... 126/351, 361, 350 R; 122/447, 448.1, 448.2, 14, 23; 431/10, 43, 46, 79, 187; 137/437, 637, 595

[56] References Cited

U.S. PATENT DOCUMENTS 2,595,385 5/1952 Johnston et al. ..... 137/595
2,815,769 12/1957 Huyck ..... 137/595
3,779,212 12/1973 Wagner ..... 431/10
4,055,164 10/1977 Wu-Heng ..... 126/351
4,770,161 9/1988 Charron ..... 126/351
4,931,013 6/1990 Brahmbhatt et al. ..... 431/10

*Primary Examiner*—James C. Yeung

[57] ABSTRACT

A gas-fired water heater includes an oxygen supply system provided with the water heater system having an oxygen supply synchronizer installed juxtapositionally to the water heater, which is synchronously opened for supplying oxygen to a gas burner, into which the gas is discharged from a gas valve of the water heater upon an opening of a water valve for supplying water to be heated by the heater, thereby causing a complete combustion of the gas for preventing a production of poisonous carbon monoxide gas.

2 Claims, 3 Drawing Sheets

GAS-FIRED WATER HEATER WITH COMBUSTION-AID SUPPLY SYSTEM

BACKGROUND OF THE INVENTION

A conventional gas-fired water heater may be operated to heat water by igniting natural gas or liquid petroleum gas from a gas supply system or cylinders, which is started by opening a water valve of a water pipe passing through the heater. If the gas-fired water heater or geyser is improperly installed such as installed in an interior of a house, the gas may be burned incompletely due to a limited oxygen supply in an interior especially in a closed interior in a cold weather season to produce poisonous carbon monoxide which may cause suffocation or even death to someone taking a bath or living in a closed room when exposed under the carbon monoxide gas.

It is therefore expected to provide an oxygen supply system in addition to the geyser.

SUMMARY OF THE INVENTION

The object of the present invention is to provide a gas-fired water heater including an oxygen supply system provided with the water heater system having an oxygen supply synchronizer installed juxtapositionally to the water heater, which is synchronously opened for supplying oxygen to a gas burner, into which the gas is discharged from a gas valve of the water heater upon an opening of a wear valve for supplying water to be heated by the heater, thereby causing a complete combustion of the gas for preventing a production of poisonous carbon monoxide gas.

DETAILED DESCRIPTION

Figure 1:
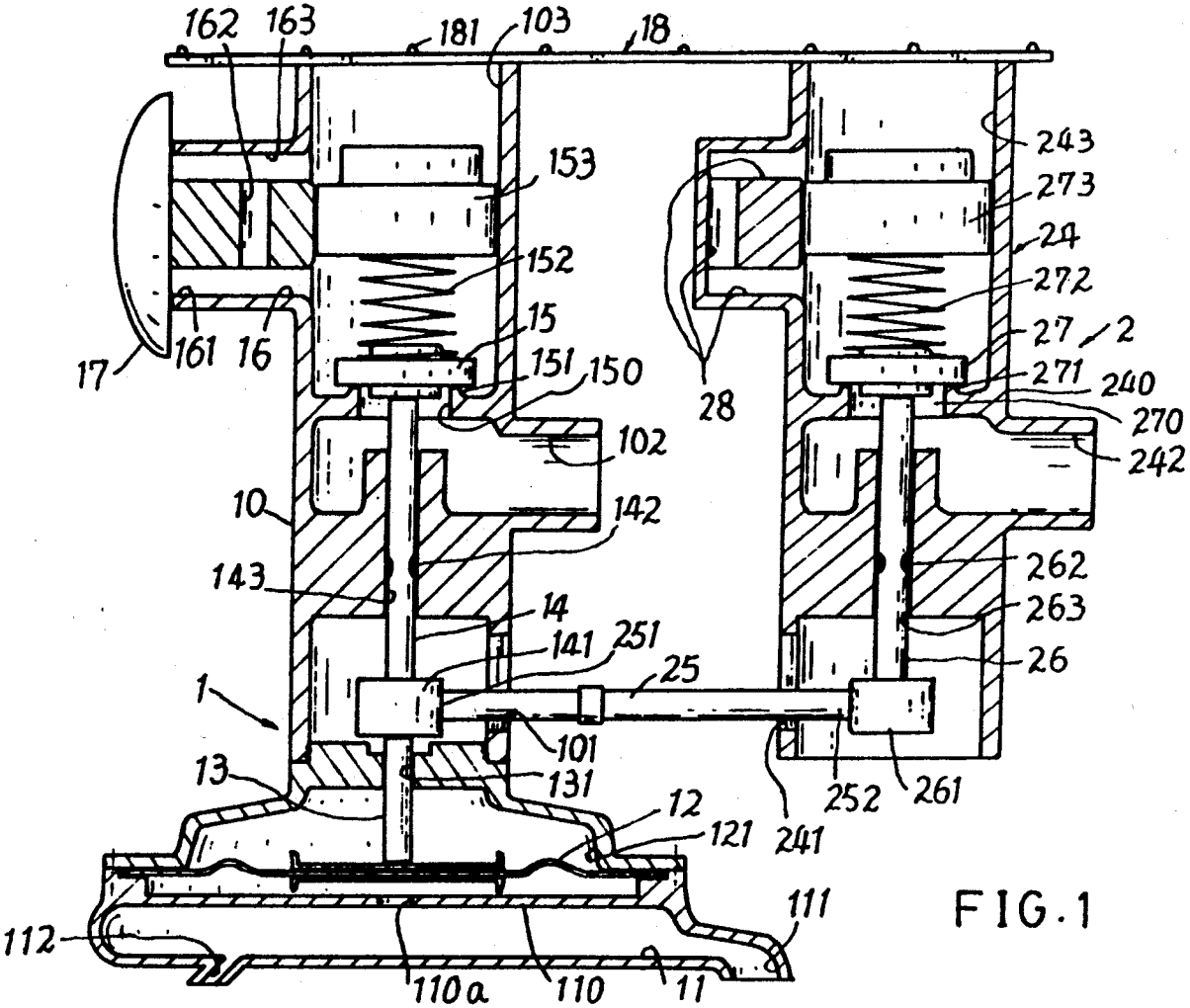
FIG. 1 is an illustration of the present invention when closed.
Figure 3:
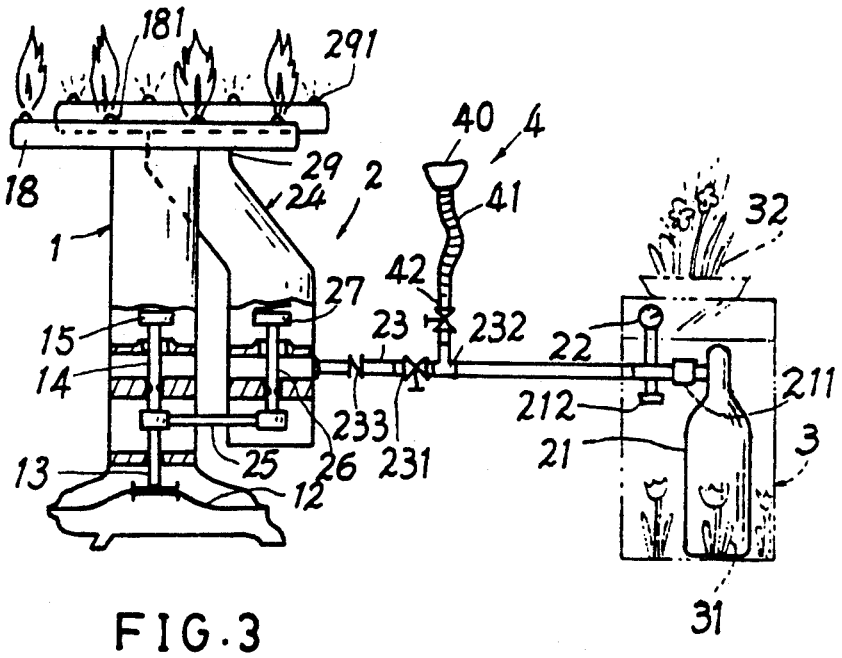
FIG. 3 is an illustration showing a complete system of gas and oxygen supplies.

As shown in FIGS. 1 and 3, the present invention comprises: a geyser 1, a combustion-aid supply system 2, a decorative container 3, and a first aid respirator 4.

The geyser 1 is a conventional gas water heater which includes: a fuel gas valve body 10, a water chamber 11 formed in a lower portion of the gas valve body 10, a diaphragm 12 secured in a diaphragm chamber 121 positioned above the water chamber 11, a diaphragm rod 13 vertically reciprocating in a lower rod hole 131 formed in a lower portion of the gas valve body 10, a gas valve stem 14 reciprocatively held in a middle rod hole 143 formed in a middle portion of the gas valve body 10 above the/diaphragm rod, a fuel gas valve plug 15 normally seating on a valve seat 151 for sealing a valve opening 150 communicated with a gas inlet port 102 formed in a middle side portion of the gas valve body 10 for inputing inlet gas from a gas source, a gas by-pass passage 16 sinuously formed in an upper side portion of the gas valve body 10 operatively communicating the valve opening 150 and a discharge port 103 formed in an upper portion of the valve body 10, a pilot gas controller 17 which is provided for controlling a by-pass gas stream directed to a pilot gas burner ignited by an ignition system which is a conventional art, not described in detail herewith, and a gas burner 18 having a plurality of gas nozzles 181 formed in the gas burner 18 communicated with the discharge port 103.

The water chamber 11 includes a water inlet port 111, a water outlet port 112 having a diameter smaller than that of the water inlet port 111, an upper partition 110 formed between the water chamber 11 and the diaphragm chamber 121, and a central opening 110*a* formed in a central portion of the partition plate 110.

The diaphragm rod 13 has its upper end portion contacting a coupling block 141 secured on a lower end portion of the gas valve stem 14.

The gas valve stem 14 includes a packing ring 142 surrounding a middle stem portion for gas tightness between the stem 14 and a stem hole 143 longitudinally formed in the valve body 10, and an upper stem portion normally contacting the valve plug 15.

The gas valve plug 15 is normally restored downwardly by a tensioning spring 152 retained on a retainer 153 fixed in an upper portion of the valve body 10 for normally sealing the valve seat 151 and opening 150 as shown in FIG. 1.

The gas by-pass passage 16 includes a side branch passage 161 communicated with the pilot gas controller 17, an vertical side passage 162 communicated with the passage 16 and an upper horizontal passage 163 communicating the vertical passage 162 with the discharge port 103.

The combustion-aid supply system 2 of the present invention for supplying combustion aid selected from oxygen, compressed air, or other combustion aids and preferably being oxygen includes: an oxygen cylinder 21, an oxygen meter 22 mounted on an oxygen conduit 23 which is connected to the oxygen cylinder 21, and an oxygen supply synchronizer 24 synchronously actuated by an actuation of the geyser 1 for opening an oxygen supply through the oxygen conduit for directing the oxygen to a gas burner 18 of the geyser 1 for enhancing a complete combustion of a gas discharged into the gas burner.

The oxygen supply synchronizer 24 includes: an oxygen valve body 240 generally positioned by side of the gas valve body 10 of the geyser 1, an actuating lever 25 having an inner end 251 of the lever laterally connected to the coupling block 141 formed on a lower portion of the gas valve stem 14 through a side slot 101 formed in the gas valve body 10 and having an outer end 252 of the lever 25 connected through a side slot 241 formed in the oxygen valve body 240 to a lower block 261 secured on a bottom portion of an oxygen valve stem 26 reciprocatively held in a stem hole 263 formed in a lower portion of the oxygen valve body 240 and packed by a packing ring 262 disposed around the oxygen valve stem 26, an oxygen valve plug 27 normally restored by a tensioning spring 272 retained on a retainer 273 formed in an upper portion of the valve body 240 to be seated on an oxygen valve seat 271 formed in a middle portion of the oxygen valve body 240 for sealing an oxygen valve opening 270 defined within the oxygen valve seat 271 and communicated with an oxygen inlet port 242 formed in a middle side portion of the oxygen valve body 240, an oxygen by-pass passage 28 sinuously formed in an upper side portion of the oxygen valve body 240, and an oxygen outlet 243 formed in an upper portion of the oxygen valve body 240 for directing oxygen to the gas burner 18.

A discharge duct 29 may be sinuously wound as shown in FIG. 3 from a discharge port 243 formed on the upper portion of the valve body 240 to direct the discharged oxygen to a plurality of oxygen nozzles 291 juxtapositionally approximating or projecting towards a plurality of gas nozzles 181 formed in the gas burner 18.

The oxygen supply synchronizer 24 may be modified to an oxygen control valve operatively opened in synchronization with an actuation (opening) of the gas water heater.

A housing or a frame (not shown) may be provided to commonly define or fix the gas valve body 10 and the oxygen valve body 240 in the housing or on the frame.

The combustion-aid supply system 2 of the present invention may be by-passed with the first-aid respirator 4 including a mask 40 to be worn by a patient such as having disease of heart attack in case of emergency, a flexible hose 41 secured with the mask 40, and a mask-side oxygen cock 42 formed on one pass leading towards the mask 40 of a triple-pass connector 232 having an inlet pass connected to an oxygen cylinder 21 and having an outlet pass connected to the oxygen synchronizer 24 by a quick-opening coupling (not shown) and controlled by a synchronizer-side oxygen cock 231 provided between the triple-pass connector 232 and the synchronizer 24.

Figure 4:
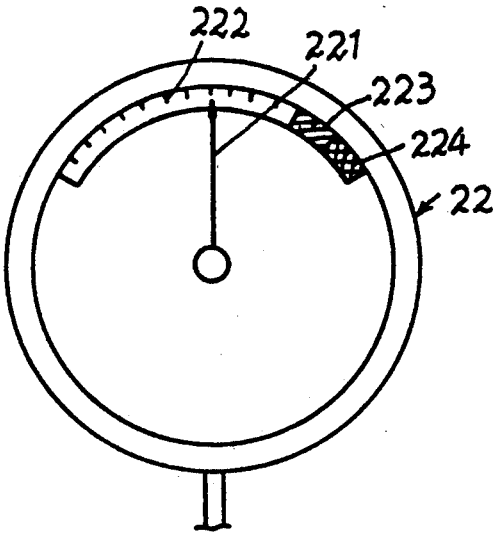
FIG. 4 shows an oxygen meter of the present invention.

The oxygen cylinder 21 is provided with a gas regulator 211, a main valve 212 and an oxygen meter 22 also as shown in FIG. 4.

The oxygen cylinder 21 may be stored in a decorative container 3 having decorative features or figures 31 printed or made thereon and having additional decorative flowers or articles 32 provided on the container for esthetic and decorative meaning as shown in FIG. 3.

The oxygen meter 22 as shown in FIG. 4 includes a pointer 221 indicating a pressure value or data shown on the scale 222 such as psi or kilogram per square centimeter, a lower pressure zone 223 such as equivalent to a capacity of one tenth of a full oxygen capacity in the cylinder 21, and a minimum (lowest) pressure zone 224 such as equivalent to one twentieth of the full capacity in cylinder 21. An alarm means may be provided (not shown) when the pointer 221 pointing at the lower pressure zone 223 to actuate a alarm sounding such as an intermittent sound for warning the user for refilling the cylinder 21, or to actuate a continuous sounding when the pointed indicating the minimum pressure zone 224 for further reminder of oxygen refilling. A switch may be provided to switch off the alarm sounding when reaching the lower pressure zone.

For safety purpose, a check valve 233 may be further provided in the oxygen conduit 23 for preventing any backflow of gas into the oxygen cylinder. However, in practical operation, the oxygen nozzle 291 and the gas nozzles 181 are opened to the atmosphere and the gas or oxygen discharged from the nozzles 181, 291 has been reduced to a very low pressure so that a worry about of any back fire or back flow of fuel into oxygen line (or vice versa) can be neglected.

Figure 2:
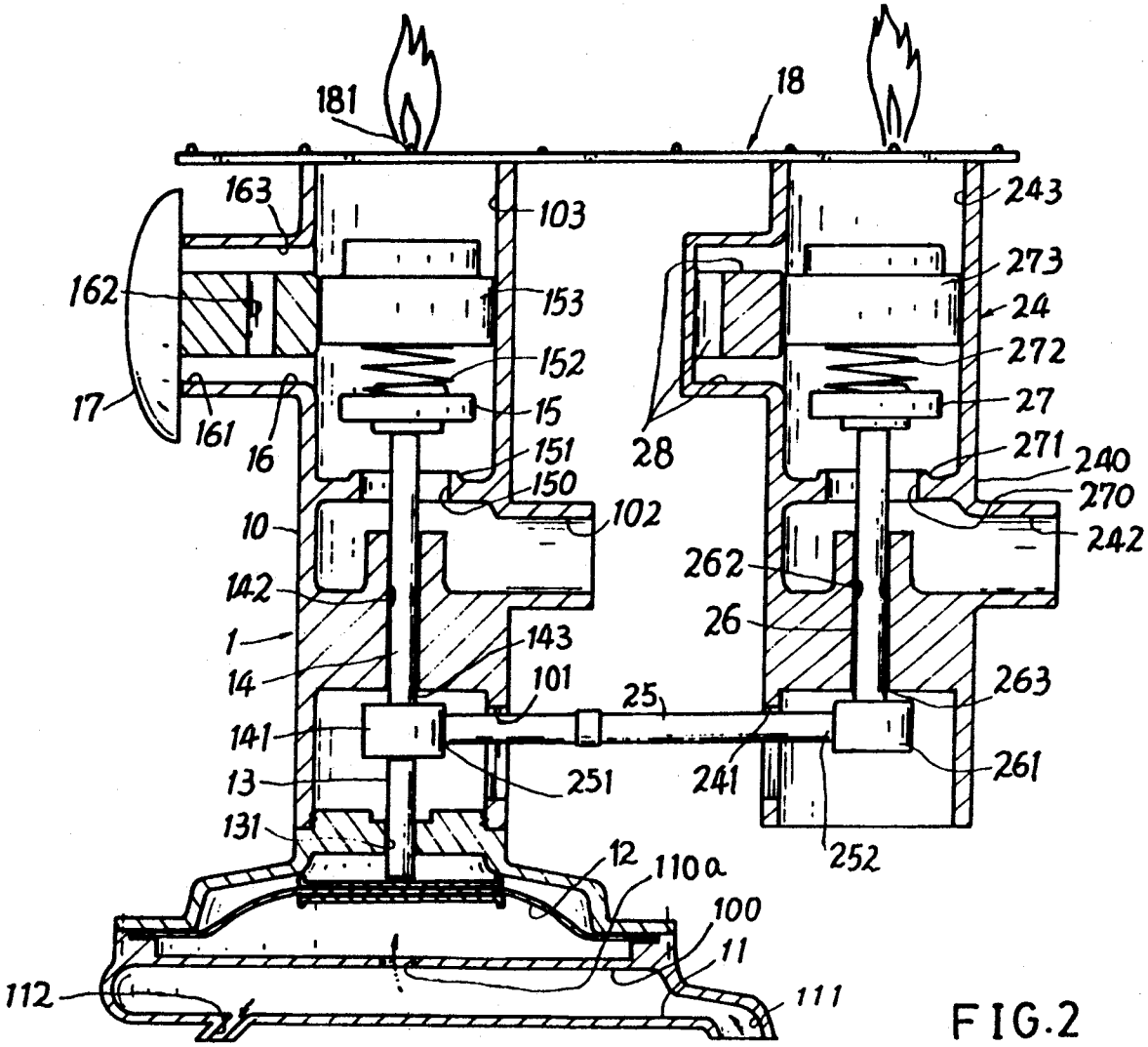
FIG. 2 is an illustration of the present invention when opened.

In using the present invention as shown in FIGS. 1, 2, when a faucet such as in a bath room is opened to develop a water pressure drop in the water chamber 11 between the water inlet 111 and the outlet 112 of the water chamber 11 (larger water quantity input, but with smaller water quantity output), causing an expansion of the diaphragm 12 as shown in FIG. 2 to raise the rod 13, the block 141 and the gas valve stem 14 to open the gas plug 15 for directing gas into burner 18. Simultaneously, the oxygen valve stem 26 is raised by the actuating lever 25 coupled to the gas stem 14 to open the oxygen valve plug 27 to lead oxygen from the inlet port 242 to be discharged from the discharge port 243 and delivered into the burner 18 or the nozzles 291 near the burner 18 for supplying enough oxygen to the gas flame for ensuring a complete combustion of the gas, thereby preventing a production of poisonous carbon monoxide gas. Meanwhile, the complete gas combustion may save fuel and reduce residual carbon black accumulated on the heater. An air pollution problem may thus be overcome.

Besides, the respirator 4 may serve as a first aid for an emergency supply of oxygen for rescuing those patients subject to suffocation or having need of oxygen gas.

I claim:

1. A gas-fired water heater comprising:

a geyser having a fuel gas valve body provided with a fuel gas valve plug normally sealing a gas valve opening for interrupting a fuel gas supply into a gas burner from a fuel gas supply source and operatively opened by a gas valve stem raised by a diaphragm as urged by a pressure drop in a water chamber formed in a lower portion of the gas valve body for directing fuel gas into said gas burner; and a combustion-aid supply system for suppling combustion aid selected from oxygen including: an oxygen cylinder, an oxygen meter mounted on an oxygen conduit which is connected to the oxygen cylinder, and an oxygen supply synchronizer synchronously actuated by an actuation of the geyser for opening the gas supply and simultaneously opening an oxygen supply through the oxygen conduit for directing the oxygen to the gas burner of the geyser for enhancing a complete combustion of the gas discharged into the gas burner;

said geyser including: said gas valve body, said water chamber formed in a lower portion of the gas valve body, the diaphragm secured in a diaphragm chamber positioned above the water chamber, a diaphragm rod vertically reciprocating in a lower rod hole formed in a lower portion of the gas valve body, a gas valve stem reciprocatively held in a middle rod hole formed in a middle portion of the gas valve body above said diaphragm rod, the gas valve plug normally seating on a valve seat for sealing the gas valve opening communicated with a gas inlet port formed in a middle side portion of the gas valve body, and said gas burner formed on an upper portion of said gas valve body; and a coupling block positioned above said diaphragm rod and secured on a lower portion of said gas valve stem for connecting an actuating lever passing through a side slot formed in a lower portion of said gas valve body for actuating said oxygen supply synchronizer; and said oxygen supply synchronizer including: an oxygen valve body generally positioned by side of the fuel gas valve body of the geyser, the actuating lever having an inner end of the lever laterally connected to the coupling block of the gas valve stem and having an outer end of the lever connected through another side slot formed in the oxygen valve body to a lower block secured on a bottom portion of an oxygen valve stem reciprocatively held in an oxygen valve stem hole formed in a lower portion of the oxygen valve body and packed by a packing ring disposed around the oxygen valve stem, an oxygen valve plug normally restored by a tensioning spring retained on a retainer formed in an upper portion of the oxygen valve body to be seated on an oxygen valve seat formed in a middle portion of the oxygen valve body for sealing an oxygen valve opening defined within the oxygen valve seat and communicated with an oxygen inlet port formed in a middle side portion of the oxygen valve body, an oxygen bypass passage sinuously formed in an upper side portion of the oxygen valve body, and an oxygen outlet formed in an upper portion of the oxygen valve body for directing oxygen to the gas burner.

2. A gas-fired water heater according to claim 1, wherein a discharge duct is sinuously wound from a discharge port formed on the upper portion of the oxygen valve body to direct the discharged oxygen to a plurality of oxygen nozzles juxtapositionally approximating or projecting towards a plurality of gas nozzles formed in the gas burner.

* * * * *